US008702117B2

(12) United States Patent
Dutaut et al.

(10) Patent No.: US 8,702,117 B2
(45) Date of Patent: Apr. 22, 2014

(54) SLIDE BOARD FOR USE ON SNOW

(75) Inventors: Jean-Luc Dutaut, La Ravoire (FR); Pierre Billon, Voiron (FR); Nicolas Puget, Novalaise (FR)

(73) Assignee: Skis Rossignol, Saint-Jean de Moirans (FR)

( * ) Notice: Subject to any disclaimer, the term of this patent is extended or adjusted under 35 U.S.C. 154(b) by 256 days.

(21) Appl. No.: 12/827,306

(22) Filed: Jun. 30, 2010

(65) Prior Publication Data

US 2011/0001304 A1 Jan. 6, 2011

(30) Foreign Application Priority Data

Jul. 6, 2009 (FR) ..... 09 54668
Oct. 2, 2009 (FR) ..... 09 56903

(51) Int. Cl.
*A63C 5/14* (2006.01)

(52) U.S. Cl.
USPC ..... 280/610; 280/609

(58) Field of Classification Search
USPC ..... 280/601, 608, 609, 610
See application file for complete search history.

(56) References Cited

U.S. PATENT DOCUMENTS 3,501,160 A * 3/1970 Lange ..... 280/609
5,366,234 A 11/1994 Rohrmoser
5,393,086 A * 2/1995 Le Masson et al. ..... 280/602
5,427,401 A * 6/1995 Liard ..... 280/609
5,573,264 A * 11/1996 Deville et al. ..... 280/602
5,782,482 A * 7/1998 Andrus et al. ..... 280/602
6,481,741 B1 * 11/2002 Porte ..... 280/609
6,986,525 B2 * 1/2006 Liard ..... 280/609
2003/0146599 A1 * 8/2003 Stefanova et al. ..... 280/609

FOREIGN PATENT DOCUMENTS

DE 2556841 A1 6/1977
EP 1410826 A1 4/2004
EP 1902758 A1 3/2008
FR 2804335 A1 8/2001
WO WO-0038801 A1 7/2000
WO 00/62877 * 10/2000 ..... A63C 5/12

OTHER PUBLICATIONS

Republique Francaise, Rapport De Recherche Preliminaire, dated Feb. 18, 2010, 2 pgs French language (FR 0956903).
Republique Francaise, Rapport De Recherche Preliminaire, dated Feb. 18, 2010, 2 pgs. French language (FR 0954668).

* cited by examiner

*Primary Examiner* — Frank Vanaman
(74) *Attorney, Agent, or Firm* — Harris Beach PLLC

(57) ABSTRACT

A slide board for use on snow has a point of maximum width located beyond the contact line. The board includes a core extending over the greater part of the board, and a plurality of mechanical reinforcement layers lying directly or indirectly on the core, extending inside the board upturn beyond the contact line. The reinforcement layers are inclusive of that part of the board comprising the longitudinal axis. At least one of the reinforcement layers has an extreme longitudinal point offset transversely relative to the longitudinal axis of the board and, in a zone defined between the contact line and the point of maximum width, the reinforcement layer has an overall cross-section which decreases between the contact line and the point of maximum width. The reinforcement layers have extreme longitudinal points offset longitudinally relative to each other.

16 Claims, 5 Drawing Sheets

SLIDE BOARD FOR USE ON SNOW

CROSS REFERENCE TO RELATED APPLICATIONS

This application claims priority under 35 U.S.C. §119 from French Patent Application No. 0954668 filed on Jul. 6, 2009 in the French Patent Office, and French Patent Application No. 0956903 filed on Oct. 2, 2009 in the French Patent Office, the entire disclosure of which is incorporated herein by reference.

FIELD OF INVENTION

The invention relates to the field of the manufacture of slide boards for use on snow, and more particularly downhill skis. It relates more specifically to skis whereof the board upturn, in other words the tip or heel, is widened to improve board lift. It is aimed more specifically at an architecture of the internal structure of such boards, intended to improve the behavior and facilitate the handling thereof.

In the remainder of the description, the invention may be described in relation more specifically to the front end upturn, in other words the tip, but it goes without saying that the same features may be transposed to the rear upturn of the board, in other words the heel, albeit by adapting the proportions and dimensions.

BACKGROUND OF INVENTION

Generally speaking, the board upturn is defined as being the part of the ski located between the contact line, defined in a standardized way, and the extreme point of the ski. The board upturns are generally known as the "tip" and the "heel" when referring to the front and rear ends respectively.

The trend towards shortening the boards to make them easier to handle, combined with adapting them for skiing in powder snows, has led to specific geometries being defined for the tip and the heel.

Formerly, and as described in the document DE2556841, skis had a dimension line which they presented at a point of maximum width substantially at the level of the front contact line, this width gradually reducing beyond the front contact line in order to form the tip. After that, in order to improve lift, there has been a tendency to push the point of maximum width of the board forwards so that it is, as shown in the document EP 1 410 826 beyond the front contact line.

However, this tip (or indeed heel) widening, dictated by considerations of lift, may have negative consequences on the behavior of the board. Indeed, conventionally, a ski comprises an internal structure consisting of a core which intrinsically lacks any high strength mechanical properties, but which allows separation from the neutral fiber of the mechanical enforcement layers. These reinforcement layers may be varied in nature, and made on the basis of metal or fibrous reinforcements impregnated with a heat-setting resin. For practical reasons related to facilitating the manufacturing process, the reinforcement layer is often extended to the end of the tip. This construction does however have one major drawback in the case of skis for which the point of maximum width is located forward from the front contact line. Indeed, the increased surface of the tip for skis of this type means that the presence of the reinforcement layer increases the rigidity thereof, both flexurally and torsionally. The clear advantage in terms of lift on powder snows therefore turns into a disadvantage in respect of harder snows, since, because of its rigidity, the tip may alter the required deformation particularly when engaged on a turn.

One solution has been proposed in the document EP1 902 758 which comprises making a slit at the end of the ski to allow the differentiated deformation of the two sides of the tip. This solution is not really satisfactory, in that it slightly reduces the torsional value of the tip and it has almost no impact on its flexural rigidity. Additionally and above all, the mechanical complexity of such a solution is a significant source of fragility for the ski, making it very difficult to use.

Another attempted solution has been proposed for surfboards in the document WO 00/38801. This solution comprises interrupting the core in the upturn zone of the board end so that only the reinforcement layers are retained beyond. The presence of these reinforcements, even closer to neutral fiber, maintains a high level of rigidity in the tip.

The invention therefore sets out to improve the flexural and torsional stiffness behavior of skis which have a tip described as wide, in other words which gets wider beyond the front contact line.

SUMMARY OF THE INVENTION

The invention therefore relates to a slide board for use on snow that relates to the family of boards which have in proximity to one of its front and/or rear ends a point of maximum width located beyond the front and/or rear contact line, a line beyond which the board upturn is defined. Likewise this board comprises an internal structure which includes a core that extends over the greater part of the board, and at least one mechanical reinforcement layer which lies directly or indirectly above or below the core, and which is extended inside the board upturn, beyond the front contact line, or rear contact line if need be.

In accordance with the invention, the board is characterized in that at least one of the reinforcement layers has an extreme longitudinal point located at an intermediate level between the contact line and the extreme point of the board upturn. Complementarily, in a zone between the contact line, front or rear depending on the circumstances, and the point of maximum width of the board, this reinforcement layer has a total cross-section, measured in a plane perpendicular to the longitudinal axis of the board, which decreases overall on moving towards the extreme point of the upturn.

Put another way, the invention comprises defining a geometry for the end of the reinforcement layer such that it does not take up the entire surface of the tip, but on the contrary, a controlled proportion of this tip such that the impact on the flexural and/or torsional rigidity is optimized. Thus, unlike the board itself, which gets wider between the front contact line and its point of maximum width, the reinforcement layer gets narrower over all or part of this area in order to reduce the impact of these intrinsic mechanical properties on the stiffness of the tip. Thus, the quantity of reinforcement layer material, measured by the cross-section of the reinforcement layer along a transverse plane, gradually reduces the closer it gets to the end of the board. The invention therefore makes it possible to alter the behavior of the ski on the edge when turning, when the tip zone located between the front contact point and the widest point of the tip is acted upon.

Depending on board type, the reinforcement layer or layers may have their extreme point at different levels relative to the end of the core. Thus, in a traditional board type, in other words with a front contact line located roughly less than 15 cm from the extreme point of the board upturn, the extreme longitudinal point of the reinforcement layer is located at an intermediate level between the end of the core and the extreme point of the board upturn. This is a configuration where the core ends in proximity to the contact line, and does not extend or extends only a little into the board upturn.

In another scenario, the contact line may be located further away from the end of the board, and a significant portion of several tens of centimeters is upturned when the board is loaded at its centre, with the ski laid flat. In this event, the core extends in a substantial way into the board upturn. In fact, since the invention sets out to control the influence exerted by the reinforcement layer in the board upturn, it is useful for the reinforcement not to extend as far as the core. Put another way, the extreme longitudinal point of the reinforcement layer is, in this case, short of the end of the core.

Various geometries may be adopted to produce this overall reduction in the quantity of the reinforcement element present in the tip.

Thus, in a first alternative embodiment, it is the overall width of the reinforcement layer, always measured transversely, which gets smaller the closer we get to the end of the board. In another alternative embodiment, the edges of the reinforcement layer may not get closer together, but conversely move apart, typically along the dimension line of the tip in the characteristic zone. In this event the quantity of material is reduced by a central cutout, defining overall a decreasing total cross-section when moving in the direction of the end of the board.

Clearly, the decrease in the cross-section is described as "overall" to cover scenarios where the profile of the reinforcement layer is not totally convex, but has some low magnitude irregularities, in other words by a few percentage points, relative to the dimensions of the characteristic zone, which extends from a point located forward from the front contact line as far as a point located to the rear of the line of greatest width of the board.

In practice, the extreme longitudinal point of the reinforcement layer may be located either in immediate proximity to the point of maximum width of the tip, in other words less than a centimeter away measured longitudinally, or else beyond or short of this level, depending on the mechanical properties required for the tip.

In the event of the reinforcement having a regular curved profile, and whereof the width gets gradually smaller going towards the board, this reinforcement layer has at its extreme longitudinal point a tangent perpendicular to the longitudinal axis of the board. Other geometries may be adopted wherein the profile of the reinforcement layer may or may not be symmetrical. Thus, the extreme longitudinal point of the reinforcement may be located on the longitudinal axis of the board, or else offset, on the inner or outer side of the board.

According to another inventive feature, it is possible to have a profile which differentiates the torsional stiffnesses along the two sides of the board. Provision may thus be made for the points from which the outline of the reinforcement layer diverges from the dimension line to be located at different longitudinal levels from one side of the board to the other. Put another way, the reinforcement may conform in shape to the dimension line over different lengths depending on whether one or other side of the board is involved. In other words, the reinforcement layer may have a cross-section which gets narrower on one side, while on the other side of the board, the reinforcement layer continues to follow the profile of the dimension line.

In one particular embodiment, the point from which the outline of the reinforcement layer diverges from the dimension line is located further forward on the inner side of the board than on the outer side. Put another way, the reinforcement remains more present on the inner side of the board, so as to promote the strongest catch on the downstream ski, on the inner side. Conversely the outer side of the upstream ski is therefore more flexible, and does not disturb the edge hold.

Likewise, the extreme longitudinal point of the reinforcement layer may be offset on the inner side of the board.

Clearly, these different configurations relative to the symmetry of the reinforcement may be combined with the asymmetry of the general profile of the tip in itself.

According to another inventive feature, the board may comprise a filling element, present beyond the characteristic reinforcement layer. This filling element has a thickness substantially equal to that of the reinforcement layer, and has a rear profile which conforms in shape to the front profile of the reinforcement layer. Put another way, this filling element extends the volume taken up by the reinforcement layer, but with a material that has poorer mechanical properties, in order not to rigidify the front of the tip. This material may for example be based on an elastomer, or on unwoven glass fibers, or again on a synthetic material.

In one alternative embodiment, the board upturn may have a thickness step on the edge of the characteristic reinforcement layer. Put another way, beyond the reinforcement layer, the layer thickness is reduced as a consequence of the fact that the reinforcement layer material is absent. Where the characteristic reinforcement layer is located above the core, the slide board has a reduction in visible thickness on the upper face of the board. Conversely, if the reinforcement layer is located underneath the core, the slide board has a reduction in visible thickness in the sole of the board.

The progressive nature of the variation in mechanical properties, moving in the direction of the end of the board, may be accentuated and improved by using a second mechanical reinforcement layer, which has an extreme point located short of the extreme longitudinal point of the first reinforcement layer. This effect may be reinforced by further increasing the number of reinforcement layers, and providing a longitudinal offset of the extreme longitudinal points of each of these reinforcement layers whereof the overall cross-section also decreases. Put another way, the mechanical properties of the board, and particularly of the tip, are the result of stacking different layers one on top of the other, which are progressively interrupted at tiered levels.

Preferably, the longest reinforcement layer is the one located closest to the core and the length of the other layers gradually decreases the further away they are from the core.

BRIEF DESCRIPTION OF THE DRAWINGS

The way of embodying the invention and the resulting advantages will become clearer from the description of the following embodiments, supported by the indexed figures wherein.

It goes without saying that the dimensions and proportions of the different layers shown in the figures are given solely for the purpose of facilitating understanding of the invention, and may diverge from the actual dimensions and proportions.

EMBODIMENTS OF THE INVENTION

Figures 1, 2:
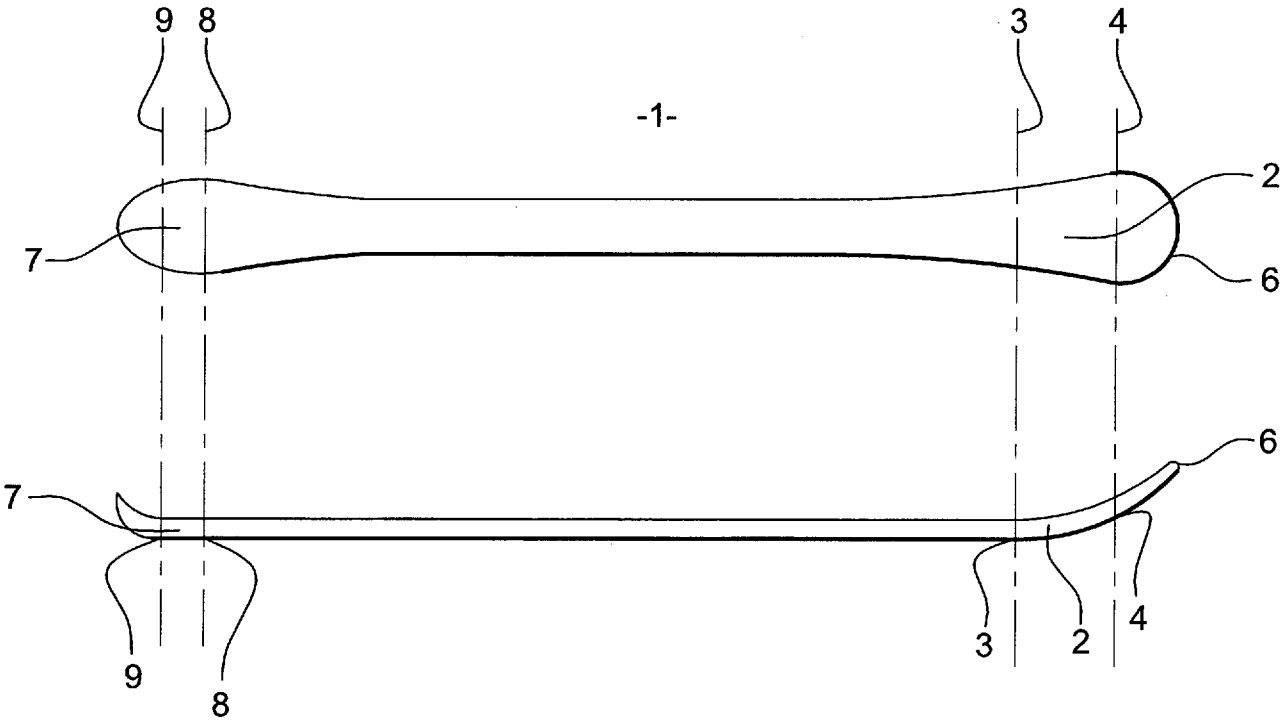
FIGS. 1 and 2 are general diagrammatic views from above and from the side respectively of a ski according to the invention.

As already mentioned, the invention relates to the family of slide boards and more particularly downhill skis which have a tip and/or a heel of large surface area. To be more precise, and as shown in FIG. 1, the ski 1 has a tip 2 defined forward from the front contact line 3, the ski being set flat. Forward from this front contact line 3, the tip 2 has a width which is maximum at the so-called "maximum width" line 4.

Symmetrically, although in different proportions as regards the dimensions, the board upturn at the rear of the ski, namely the heel 7, is defined to the rear of the rear contact line 8. It may have a maximum width line 9 also located to the rear of the rear contact line 8.

Figure 3:
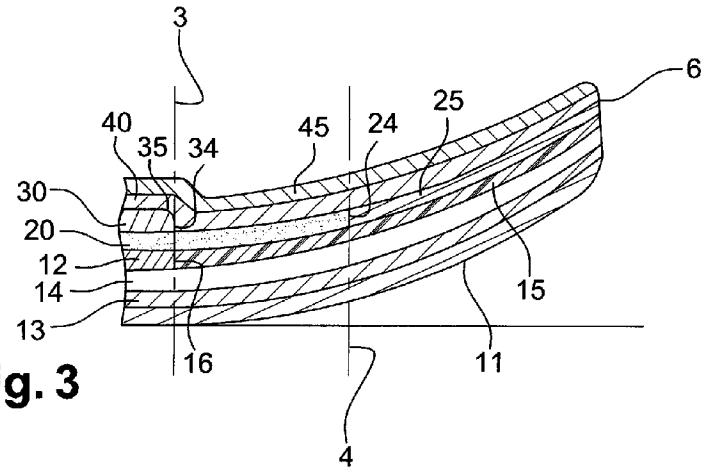
FIG. 3 is a longitudinal cross-section view of the tip of a ski implemented in accordance with the first inventive embodiment.

To be more precise, and in an embodiment example shown in FIG. 3, the tip 2 is implemented by assembling the following layers.

First of all, the sole 11 forms the lower layer, which comes into direct contact with the snow. The board also includes a core 12, which may be a pre-machined core, or else a core injected in situ. Between the core 12 and the sole 11 there are one or more reinforcement layers 13, 14, as shown in FIG. 3. These reinforcements may be based on metal sheets, fibrous reinforcements impregnated with a heat-setting resin. It is of course possible to combine different reinforcements of similar or different composition. In the form shown, the lower reinforcement layers 13, 14, are of similar geometry to that of the sole and therefore extend as far as the end 6 of the tip.

As shown in FIG. 3, the core 12 extends until in proximity to the front contact line 3. Beyond, a filling element 15 extends the volume of the core 12 lying on the reinforcement layer 14, and does so as far as the end 6 of the tip. This element may be an elastomer to ensure the resistance of the tip to large-scale deformations.

Figure 4:
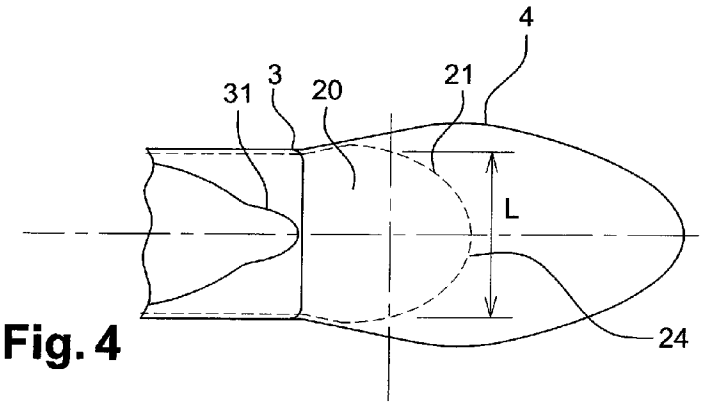
FIG. 4 is a diagrammatic view from above of the tip in FIG. 3.

In accordance with the invention, the ski has a reinforcement layer 20 which extends beyond the end 16 of the core 12. As can be seen in FIG. 4, the front profile 21 of the reinforcement 20 has a curved and convex shape in such a way that the width L of the reinforcement 20, measured transversely, i.e. perpendicular to the longitudinal axis of the ski, decreases, moving towards the end 6 of the board. Given the external shape of this profile the width L is then equivalent to the overall cross-section value.

In the form shown in FIG. 4, this width L decreases, from substantially the front contact line 3, until in proximity to the line of maximum width 4, representing a point of tangency 24 substantially perpendicular to the longitudinal axis.

Beyond the front edge 21 of the reinforcement layer 20, the structure of the board comprises a filling element 25, of thickness substantially similar to that of the reinforcement layer 20, so that the interruption of the reinforcement layer 20 does not alter the overall thickness of the board. In practice, this filling element 25 may be made out of a material such as rubber or the like, and therefore preferably has slightly rigid mechanical properties. The profile of the edge 21 of the reinforcement layer 20 is designed to obtain a flexural and torsional tip stiffness which is optimized, and particularly reduced. The level from which the width L of the reinforcement layer 20 decreases, may thus vary and be positioned more or less forward from the end 16 of the core, depending on whether or not it is required to reduce the flexural stiffness Likewise, the extreme longitudinal point 24 of the reinforcement layer 20 may also be positioned at a greater or lesser distance, rearward or forward from the point of maximum width, aligned on the horizontal axis, or else offset relative thereto.

As shown in FIG. 3, the reinforcement layer 20 receives a second reinforcement layer 30 which also has a curved profile 31. This profile 31 is such that the end 34 of the reinforcement is in proximity to the front contact line 3, in proximity also to the end 16 of the core 12. This second reinforcement layer 30 is covered as shown in FIG. 3 with a reinforcement layer 40, typically based on a fibrous material impregnated with a resin, and which conforms in shape to the kink 35 formed by the end of the reinforcement 30. This reinforcement layer 40 extends as far as the end of the board. This reinforcement 40 is covered with a decorative and protective layer 45 which extends of course as far as the end 6 of the board.

Figure 5:
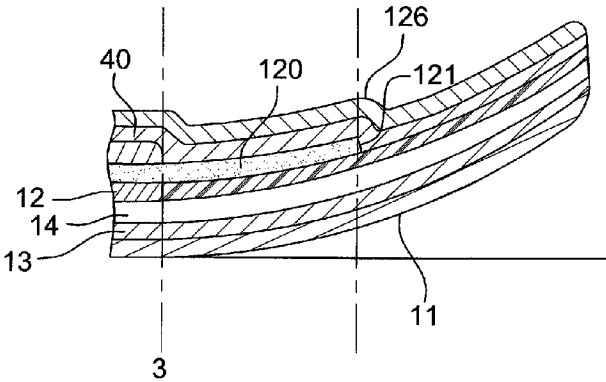
FIG. 5 is a longitudinal cross-section view of the tip of a ski implemented in accordance with the second inventive embodiment.
Figure 6:
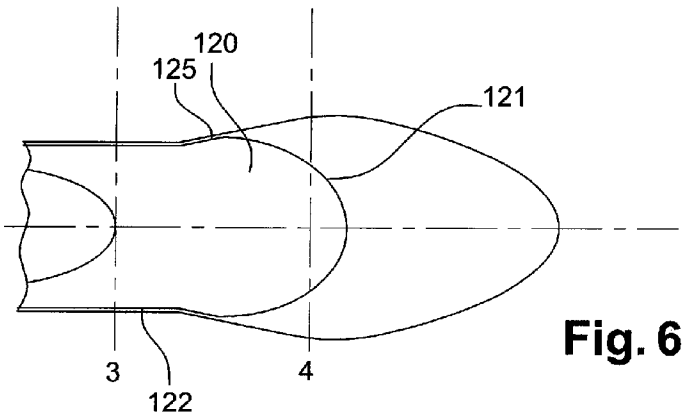
FIG. 6 is a diagrammatic view from above of the tip in FIG. 5.

In a second example shown in FIGS. 5 and 6, the structure of the board is similar, and differs from the example in FIGS. 3 and 4 by the fact that the width reduction zone of the reinforcement layer 120 is less extensive. Indeed, this reduction does not start straightaway at the point on the front contact line, but at an intermediate level 125. Thus, directly forward from the front contact point 3, the profile 122 of the reinforcement layer 120 means that the width thereof is slightly increasing. Complementarily, and as shown in FIG. 5, the interruption of the reinforcement layer 120 causes a thickness step 126 on the upper face of the board, since no filling element is provided further forward than the reinforcement layer 120.

Figure 7:
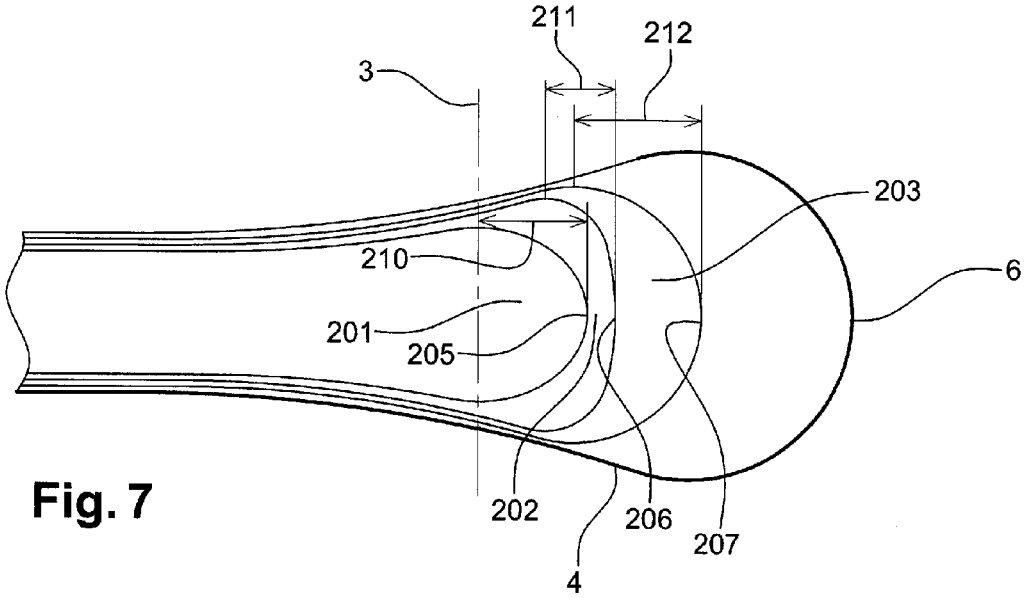
FIG. 7 is a view from above showing a third inventive embodiment.

Clearly, there are multiple possible inventive alternatives. Thus, as shown in FIG. 7, the board may comprise three successive reinforcements 201, 202, 203 which each have a progressive width reduction zone 210, 211, 212. These three reinforcements each have an extreme longitudinal point 205, 206, 207 which are substantially apportioned and offset longitudinally. These different reinforcements may be either directly stacked one on another, or separated from each other by other reinforcement layers which for their part extend as far as the end 6 of the board, or else by filling elements without major influence on the mechanical properties of the board. These different reinforcement layers may also be apportioned above and below the core depending on the mechanical properties required.

Figure 8:
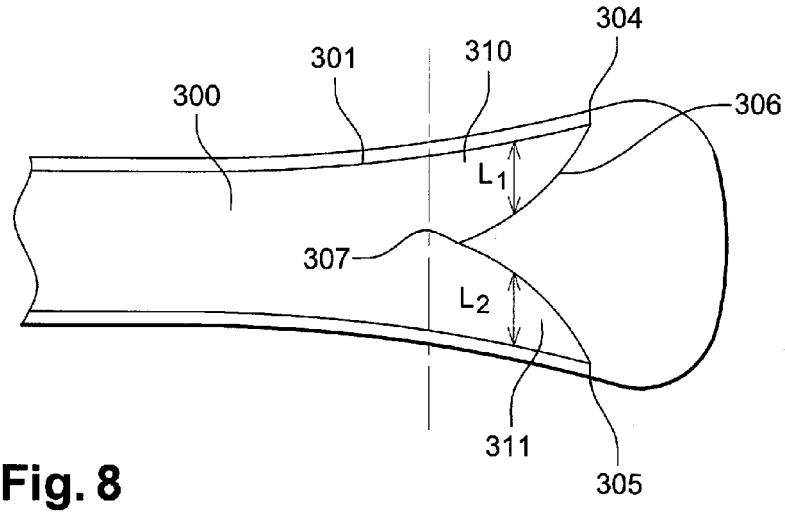
FIG. 8 is a view from above of a tip of a ski comprising a reinforcement layer according to an alternative geometry.

Other alternatives are also conceivable as regards the geometry of the reinforcements. If, as shown in FIG. 8 the reinforcement layer 300 presents a profile 301 which follows the dimension line 320 in the zone located directly forward from the front contact line 3. The overall width of the reinforcement therefore tends at this level to increase in order to follow the width of the board. However, beyond the extreme longitudinal points 304, 305, located in proximity to the dimension line 320, the front of the reinforcement layer 300 has a V-shaped cut 306 or similar, which has a central point 307 located set back longitudinally relative to the extreme lateral longitudinal points 304, 305. It follows that the cross-section of the reinforcement layer 300, measured in a plane perpendicular to the longitudinal axis of the board, decreases moving from the singular point 307 to the extreme longitudinal points 304, 305. This cross-section may, at constant thickness, be assessed by the sum of the widths L1, L2 of the two branches 310, 311 of the front of the reinforcement layer 300. Said geometry can be used to reduce the torsional and flexural stiffness in different proportions. Combinations of the different profiles disclosed may be implemented depending on the mechanical properties required. Through the alternatives not shown in the figures, provision may be made for the profile of the end of the reinforcement layer not to be symmetrical, in other words for the extreme point not be aligned on the longitudinal axis of the ski, but offset transversely relative to this axis.

Figure 9:
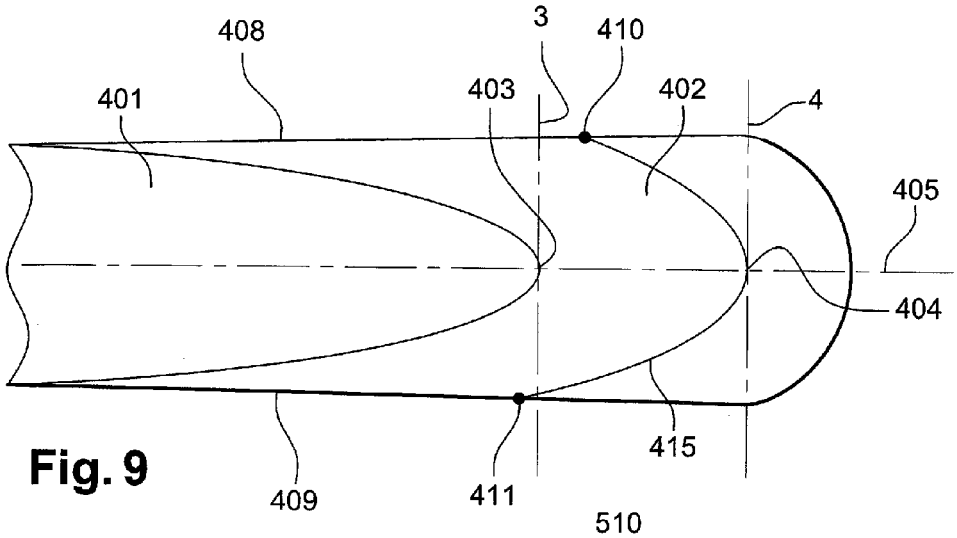
FIGS. 9, 10 and 11 are views from above of a tip of a right ski implemented according to alternatives wherein the profile of the reinforcement layer is asymmetrical.

FIG. 9 thus shows a configuration in which two reinforcements 401, 402 are stacked one on another. These two reinforcements 401,402 have their extreme longitudinal points 403,404 which are aligned on the longitudinal axis 405 of the board. As regards the reinforcement 402 extending the furthest forward, it should be noted that the profile of the cross-section reduction zone is asymmetrical. To be more precise, the profile 402 follows the dimension line 408,409 as far as two points 410,411 from which the profile 415 gets closer to the longitudinal axis of the board 405. It will be noted that the two points 410,411 are not located at the same longitudinal level of the board, but are conversely offset. To be more precise and in the example shown, the point 411 the furthest rearward is located to the rear of the front contact line 3. Conversely, the point 410 furthest forward is located forward from the front contact line 3. It follows that the mechanical behavior of the board is different from one side to the other, which may be advantageous for some types of usage. Indeed, on the side where the point 410 is located the furthest forward, the board has increased local stiffness, greater than the stiffness on the opposite side, since beyond the point 411, the reinforcement is less present. This property may be used with a different configuration between the right and left skis. To be more precise, the stiffest side is preferentially placed on the inner side. In this configuration, the downstream ski, which has most press holds applied to it, has increased stiffness, flexural and torsional, on the inner edge on which ski edging is performed. Conversely, on the upstream ski, the outer side is relatively more flexible, with the result that edge engagement is weaker. This configuration reduces edge errors which may cause the skier to fall.

Figure 10:
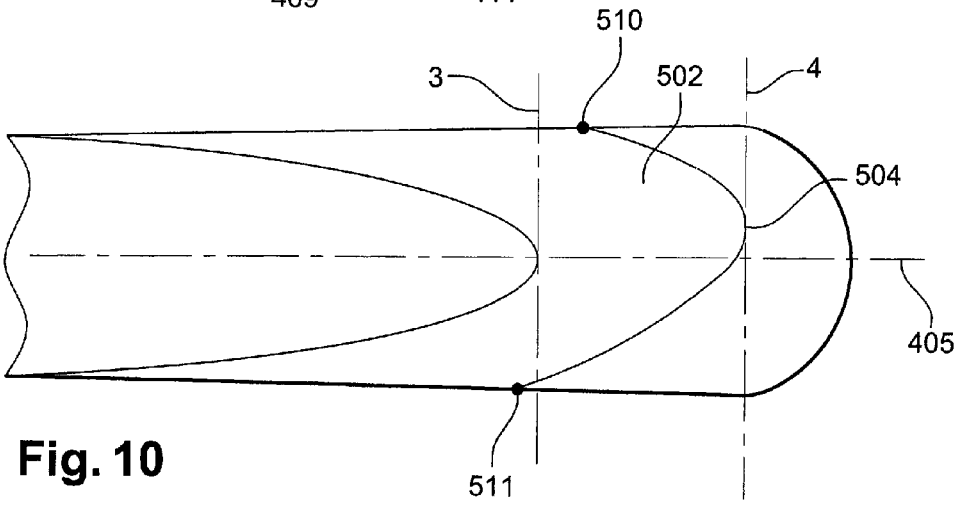
Figure 11:
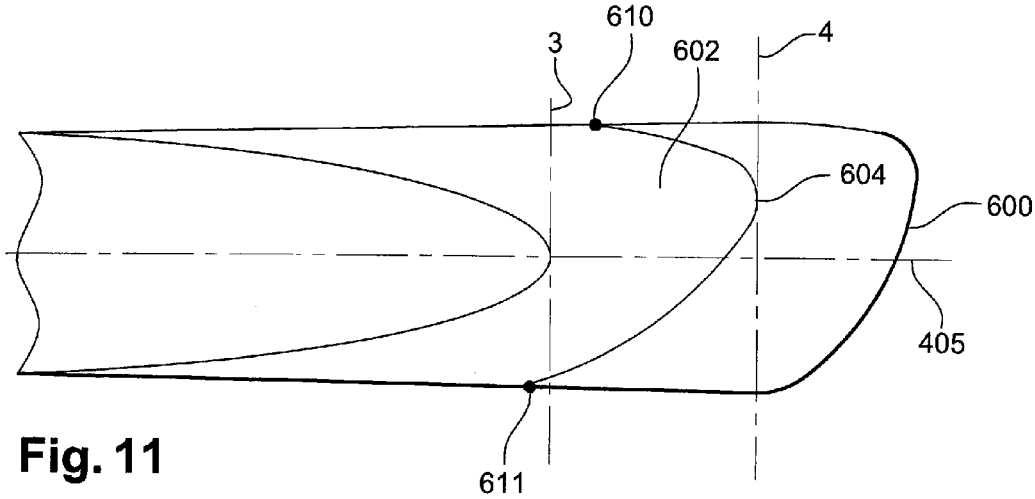

In an alternative embodiment shown in FIG. 10, the reinforcement 502 has its extreme longitudinal point 504 which is offset relative to the longitudinal axis 405 of the ski, on the inner side of the ski, i.e. on the left of the longitudinal axis for the right ski shown. The points 510 and 511, from which the reinforcement 502 diverges from the dimension line, are also placed asymmetrically and offset longitudinally. In the alternative shown in FIG. 11, the asymmetry of the reinforcement 602 and in particular the offset positioning of the extreme front point 604, are combined with an overall asymmetrical geometry of the tip, whereof the front point 600 is offset relative to the longitudinal axis 405, and on the same side as the extreme longitudinal point 604 of the reinforcement 602. Multiple alternatives may be implemented by combining the longitudinal offsets of the extreme lateral points of the reinforcements, the asymmetry of the extreme longitudinal point and the general shape, whether symmetrical or not, of the tip.

Figure 12:
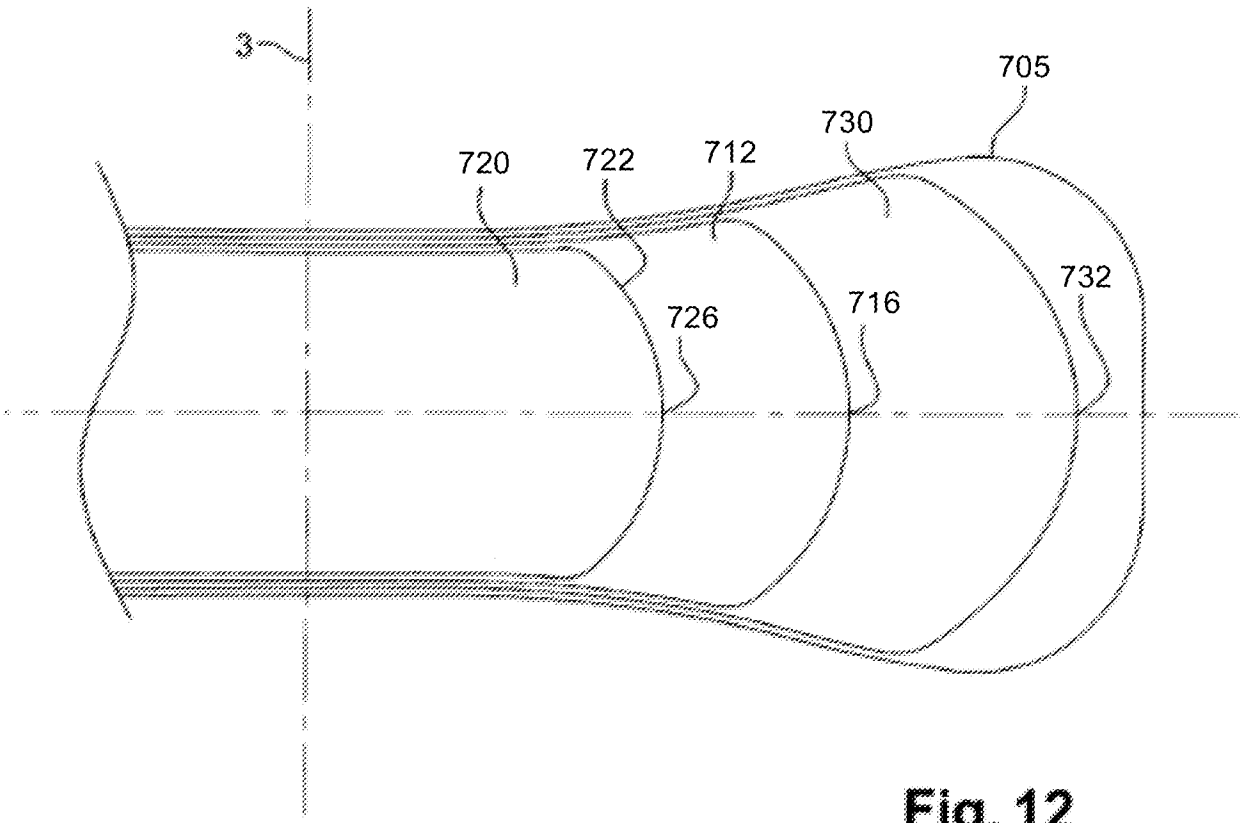
FIG. 12 is a view from above of a tip of a ski wherein a reinforcement layer is interrupted to the rear of the end of the core.

In another alternative shown in FIG. 12, the front contact line 3 is set further back than in the embodiments in the other figures. It will be seen that the core 712 clearly extends inside the tip upturn, as far as an extreme point 716 located further forward than the front contact line 3. The ski has a first reinforcement 720 whereof the point furthest forward 726 is located to the rear of the extreme point 716 of the core. The profile of the cross-section reduction zone 722 may be adapted according to the different alternatives already mentioned. In this way the influence of the reinforcement 720 in the tip upturn zone is reduced. It is possible, but not necessary, for the ski to comprise a second reinforcement 730 which has an end 732 beyond the widest point 705 of the ski.

It is clear from what has been said above that the internal structure of the inventive boards can be used to combine in a tip (or heel) good flexural and torsional stiffness properties with improved lift properties. It is important to note that this then allows the torsional and flexural stiffness to be controlled, and in particular reduced, mainly in the zone located between the front contact point and the widest point, a zone acted upon when advancing on the edge of the ski.

The invention claimed is:

1. A slide board for use on snow, the slide board having in proximity to one of its front and/or rear ends a point of maximum width located beyond a front and/or rear contact line, beyond which a board upturn is defined, the slide board comprising:

a core extending over the greater part of the board;

an outer protective layer; and a first mechanical reinforcement layer disposed between the core and the outer protective layer, the first reinforcement layer extending beyond the front and/or rear contact line along and inclusive of a longitudinal axis, the first reinforcement layer having an extreme longitudinal point located at an intermediate level between the contact line and an extreme point of the board upturn, the first reinforcement layer having an overall cross-section, measured in a plane perpendicular to the longitudinal axis of the board, which, moving towards the extreme point of the board upturn, increases and decreases in a zone defined between the contact line and the point of maximum width.

2. The slide board of claim 1, wherein the extreme longitudinal point of the first reinforcement layer is located at an intermediate level between an end of the core and the extreme point of the board upturn.

3. The slide board of claim 1, wherein the extreme longitudinal point of the first reinforcement layer is short of the end of the core.

4. The slide board of claim 1, wherein the extreme longitudinal point of the first reinforcement layer is located in immediate proximity to the point of maximum width of the board.

5. The slide board of claim 1, wherein the extreme longitudinal point of the first reinforcement layer is located beyond the point of maximum width of the board.

6. The slide board of claim 1, wherein the extreme longitudinal point of the first reinforcement layer is located short of the point of maximum width of the board.

7. The slide board of claim 1, wherein the extreme longitudinal point of the first reinforcement layer is offset transversely relative to the longitudinal axis of the board.

8. The slide board of claim 7, wherein the extreme longitudinal point of the first reinforcement layer is offset transversely on the inner side of the board relative to the longitudinal axis.

9. The slide board of claim 1, wherein points from which an outline of the first reinforcement layer diverges from a dimension line are located at different longitudinal levels from one side of the board to the other.

10. The slide board of claim 9, wherein the point from which the outline of the reinforcement layer diverges from the dimension line is located further forward on an inner side of the board than on an outer side.

11. The slide board of claim 1, further comprising a second reinforcement layer covering the first reinforcement layer, the second reinforcement layer extending longitudinally to the extreme point of said board upturn.

12. The slide board of claim 11, wherein the second reinforcement layer is formed of a fibrous material impregnated with a resin.

13. A slide board for use on snow, the slide board having in proximity to one of its front and/or rear ends a point of maximum width located beyond a front and/or rear contact line, beyond which a board upturn is defined, the slide board comprising:

a core extending over the greater part of the board;

an outer protective layer; and a first mechanical reinforcement layer disposed between the core and the outer protective layer, the first reinforcement layer extending beyond the front and/or rear contact line along and inclusive of a longitudinal axis, the first reinforcement layer having an extreme longitudinal point located at an intermediate level between the contact line and an extreme point of the board upturn, the first reinforcement layer having an overall cross-section, measured in a plane perpendicular to the longitudinal axis of the board, which increases proximate to the front and/or rear contact line and then, in a zone defined between the contact line and the point of maximum width, decreases moving towards the extreme point of the board upturn; and a second reinforcement layer covering the first reinforcement layer, the second reinforcement layer extending longitudinally to the extreme point of said board upturn;

wherein the extreme longitudinal point of the first reinforcement layer forms a thickness step, and the second reinforcement layer follows the thickness step formed by the first reinforcement layer.

14. A slide board for use on snow, the slide board having in proximity to one of its front and/or rear ends a point of maximum width located beyond a front and/or rear contact line, beyond which a board upturn is defined, the slide board comprising:

a core extending over the greater part of the board;

an outer protective layer; and a first mechanical reinforcement layer disposed between the core and the outer protective layer, the first reinforcement layer extending beyond the front and/or rear contact line along and inclusive of a longitudinal axis, the first reinforcement layer having an extreme longitudinal point located at an intermediate level between the contact line and an extreme point of the board upturn, the first reinforcement layer having an overall cross-section, measured in a plane perpendicular to the longitudinal axis of the board, which increases proximate to the front and/or rear contact line and then, in a zone defined between the contact line and the point of maximum width, decreases moving towards the extreme point of the board upturn;

a second reinforcement layer covering the first reinforcement layer, the second reinforcement layer extending longitudinally to the extreme point of said board upturn; and a third mechanical reinforcement layer disposed between the core and the outer protective layer, the third reinforcement layer extending longitudinally and having an extreme point located short of the extreme longitudinal point of the first reinforcement layer.

15. The slide board of claim 14, wherein the third reinforcement layer is positioned between the first reinforcement layer and the second reinforcement layer.

16. The slide board of claim 14, wherein the extreme point of the third reinforcement layer forms a kink on the outer protective layer.

* * * * *